US007640999B2

(12) United States Patent
Patton

(10) Patent No.: US 7,640,999 B2
(45) Date of Patent: Jan. 5, 2010

(54) COILED TUBING AND DRILLING SYSTEM

(75) Inventor: Bartley Patton, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 11/459,800

(22) Filed: Jul. 25, 2006

(65) Prior Publication Data

US 2008/0023227 A1 Jan. 31, 2008

(51) Int. Cl.
*E21B 19/22* (2006.01)
*E21B 19/00* (2006.01)

(52) U.S. Cl. ..... 175/57; 175/203; 166/77.2

(58) Field of Classification Search ..... 175/57, 175/162, 203; 166/384, 77.1, 77.2
See application file for complete search history.

(56) References Cited

U.S. PATENT DOCUMENTS 5,738,173 A * 4/1998 Burge et al. ..... 166/385
5,809,916 A * 9/1998 Strand ..... 166/77.2
5,842,530 A 12/1998 Smith
5,918,671 A * 7/1999 Bridges et al. ..... 166/77.3
6,003,598 A 12/1999 Andreychuk
6,332,501 B1 12/2001 Gipson
6,408,955 B2 6/2002 Gipson
6,431,286 B1 8/2002 Andreychuk
6,502,641 B1 1/2003 Carriere
6,973,979 B2 12/2005 Carriere
7,185,708 B2 * 3/2007 Wood et al. ..... 166/379
7,188,686 B2 * 3/2007 Folk et al. ..... 175/162
2003/0079883 A1 5/2003 McCulloch
2003/0098150 A1 5/2003 Andreychuk
2004/0206551 A1 * 10/2004 Carriere et al. ..... 175/203
2005/0082064 A1 4/2005 Foster
2005/0269104 A1 12/2005 Folk et al.

* cited by examiner

*Primary Examiner*—Shane Bomar
(74) *Attorney, Agent, or Firm*—Michael Flynn; David Cate; Robin Nava

(57) ABSTRACT

A technique facilitates combined drilling and coiled tubing operations from a single bed of a rig. A mast is mounted to the bed, and a coiled tubing injector is connected to the mast. The coiled tubing injector is able to move coiled tubing into and out of a wellbore. A starter head also is mounted to the mast. The starter head is rotatable to make and break connections of tool string components. However, the starter head generally is rotationally stationary during drilling operations.

19 Claims, 5 Drawing Sheets

COILED TUBING AND DRILLING SYSTEM

BACKGROUND

A variety of drilling rigs are used in the formation and preparation of wellbores for production of well fluids or for other well related procedures. Drilling rigs have been designed to selectively drill using coiled tubing and jointed pipe. In one example, a rig includes a base, a mast and a tubing injector used to inject coiled tubing into the wellbore and to withdraw coiled tubing from the wellbore. The rig also includes a top drive mounted to the mast to perform a variety of drilling related operations.

The top drive is functional to provide drill stem rotation for both drilling and tool string make-up. The top drive also supports the rotating pipe load and provides a sealed swivel arrangement for conveying drilling fluid. Top drives can also be used to handle drill string components and to torque connections between drill string components. However, top drives are relatively expensive devices that have high hydraulic power requirements and pose substantial risk to the drilling operation in the event of top drive failure. The potential for top drive failure also is of concern, because top drives tend to be relatively complex devices that are required to provide rotational motion for a variety of tasks.

SUMMARY

In general, the present invention provides a system and a methodology for drilling and coiled tubing operations in which the components are combined in a transportable vehicle. The system and methodology also provide a substantial amount of the functionality of a top drive without the expense and the complexity of top drives. The present technique utilizes a bed and a mast mounted to the bed. A coiled tubing injector is mounted to the mast to move coiled tubing into and out of the well. A starter head also is mounted to the mast to provide linear and rotational functionality that enables the manipulation, connection, and disconnection of tool string components.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

In the following description, numerous details are set forth to provide an understanding of the present invention. However, it will be understood by those of ordinary skill in the art that the present invention may be practiced without these details and that numerous variations or modifications from the described embodiments may be possible.

The present invention relates to a system and methodology for drilling operations and coiled tubing operations with a single rig. The combined coiled tubing and drilling rig is designed to avoid the use of a top drive or power swivel system, thereby reducing the hydraulic requirements, risk factors and cost factors of conventional coiled tubing drilling units. Generally, the system and methodology utilize a rig having a bed with a mast mounted to the bed. A coiled tubing spool also is rotatably mounted to the bed via a spindle, and a coiled tubing injector is mounted to the mast to facilitate coiled tubing operations. Additionally, a movable starter head is mounted to the mast to facilitate the making and breaking of connections between tool string components, e.g. bottom hole assembly components or other tool string components. The starter head does not power the actual drilling, but rather uses a smaller motor, such as an electric motor or a hydraulic motor, sized to impart rotational motion to the tool string components sufficient for the making, i.e. connecting, and breaking, i.e. disconnecting, of the tool string components. The power for actual drilling is provided by a downhole drill motor that is moved downhole into a wellbore with the drill string. The starter head typically does not rotate during drilling, and can be designed to counter the torque generated by the drilling operation.

Figure 1:
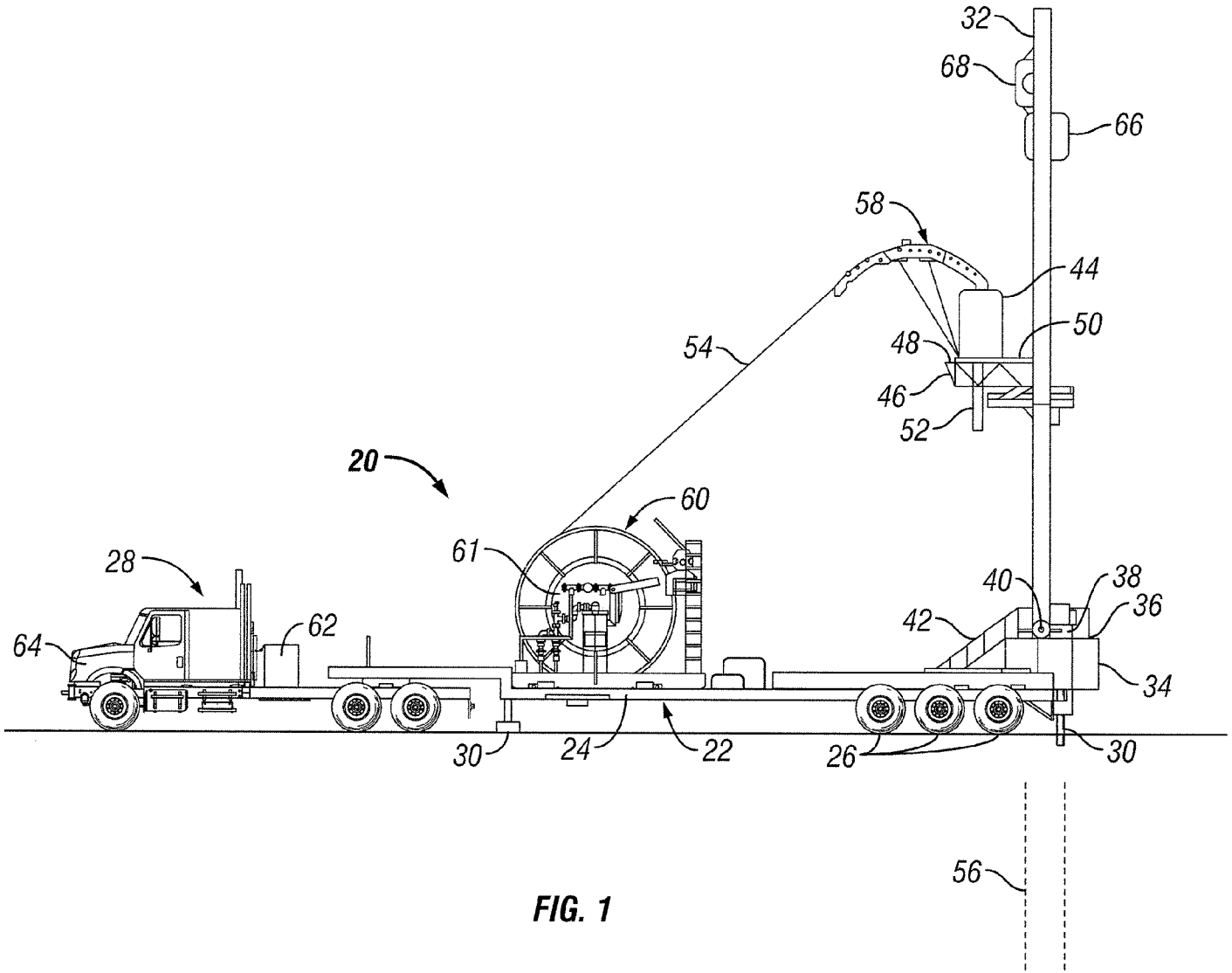
FIG. 1 is a side view of a drilling and coiled tubing rig, according to an embodiment of the present invention.

Referring generally to FIG. 1, an embodiment of the present invention is illustrated. In this embodiment, a coiled tubing and drilling rig 20 is illustrated as comprising a bed 22. By way of example, bed 22 may be formed as a trailer 24, such as a truck trailer, supported by a plurality of wheels 26. In this embodiment, bed 22 is designed for engagement with a motorized vehicle 28, e.g. a tractor, to form a tractor-trailer vehicle that can be driven from one well site to another. In many embodiments, trailer 24 and motorized vehicle 28 are designed to be road legal, enabling transport of the coiled tubing and drilling equipment over public highway systems. It should be noted, however, that bed 22 can be constructed in other forms, including self-propelled forms that do not rely on a separate tractor for movement of the coiled tubing and drilling rig. Bed 22 also may comprise stabilizing equipment, such as a plurality of stabilizer legs 30 that can be selectively pressed against the ground surface to both level and stabilize bed 22 during drilling operations and coiled tubing operations.

Coiled tubing and drilling rig 20 further comprises a mast 32 mounted to the bed 22. In the embodiment illustrated, mast 32 is mounted to a structure 34 having a platform 36 on which is mounted a component support structure 38, such as a rotary table. The component support structure 38 is designed to engage tool string components, such as tubing, by appropriate engagement mechanisms (not shown), e.g. slips, as are known to those of ordinary skill in the art. The entire mast 32 can be pivotably mounted on a pivot member 40 to enable the mast to be pivoted downwardly to a storage position for transport to another well site. A hydraulic cylinder 42 can be used to move mast 32 between the storage position and an upright, operating position, as illustrated in FIG. 1.

A coiled tubing injector 44 is mounted to mast 32 via a mounting structure 46. Mounting structure 46 can be designed to provide a platform 48 on which coiled tubing injector 44 is movably mounted via a shuttle mechanism 50. Shuttle mechanism 50 can be used to move coiled tubing injector 44 into and out of alignment with mast 32, for example, depending on the type of drilling operation or coiled tubing operation being performed. The coiled tubing injector 44 also may comprise a lubricator 52 designed to guide a coiled tubing 54 out of coiled tubing injector 44 when coiled tubing is being deployed into a wellbore 56. An injector arch 58 may be connected to or positioned above the upper side of coiled tubing injector 44. The injector arch 58 is an arched structure that facilitates flexing of coiled tubing 54 and movement of coil tubing 54 into injector 44.

Coiled tubing and drilling rig 20 may further comprise a coiled tubing spool 60 rotatably mounted on bed 22. Coiled tubing 54 is wrapped around spool 60 for delivery to coiled tubing injector 44, as illustrated. During coiled tubing operations, spool 60 is selectively rotated about a spindle 61 to deliver coiled tubing 54 into wellbore 56 or to withdraw coiled tubing from the wellbore. The spool 60 can be rotated by a conventional coiled tubing spool motor. In one embodiment, power to rotate coiled tubing spool 60, to extend and contract cylinder 42, and to perform various other powered operations on rig 20 can be provided hydraulically via a hydraulic supply 62 and a power source 64 for pressurizing hydraulic fluid, e.g. an internal combustion engine and hydraulic pump.

A starter head 66 also is mounted to mast 32 for movement along the mast 32. For example, starter head 66 can be lowered or raised along mast 32 by a mechanism 68 which can have a variety of forms depending on the specific application. For example, mechanism 68 may comprise a traveling block, a traveling block integrated into the mast, a rack and opinion system, a winch or other suitable mechanisms for mechanically raising and lowering starter head 66. As will be explained in greater detail below, starter head 66 can be used in the assembly of tool string components, to support the pipe load, to provide a sealed swivel arrangement for conveying drilling fluid, to provide hydraulically manipulated elevators for moving tool string components, and to apply proper torque to the connections between tool string components, e.g. drill string components. The starter head 66 also may be mounted on an apparatus, such as platform 48 and shuttle mechanism 50, to enable movement of starter head 66 off of the well center when necessary.

Figure 2:
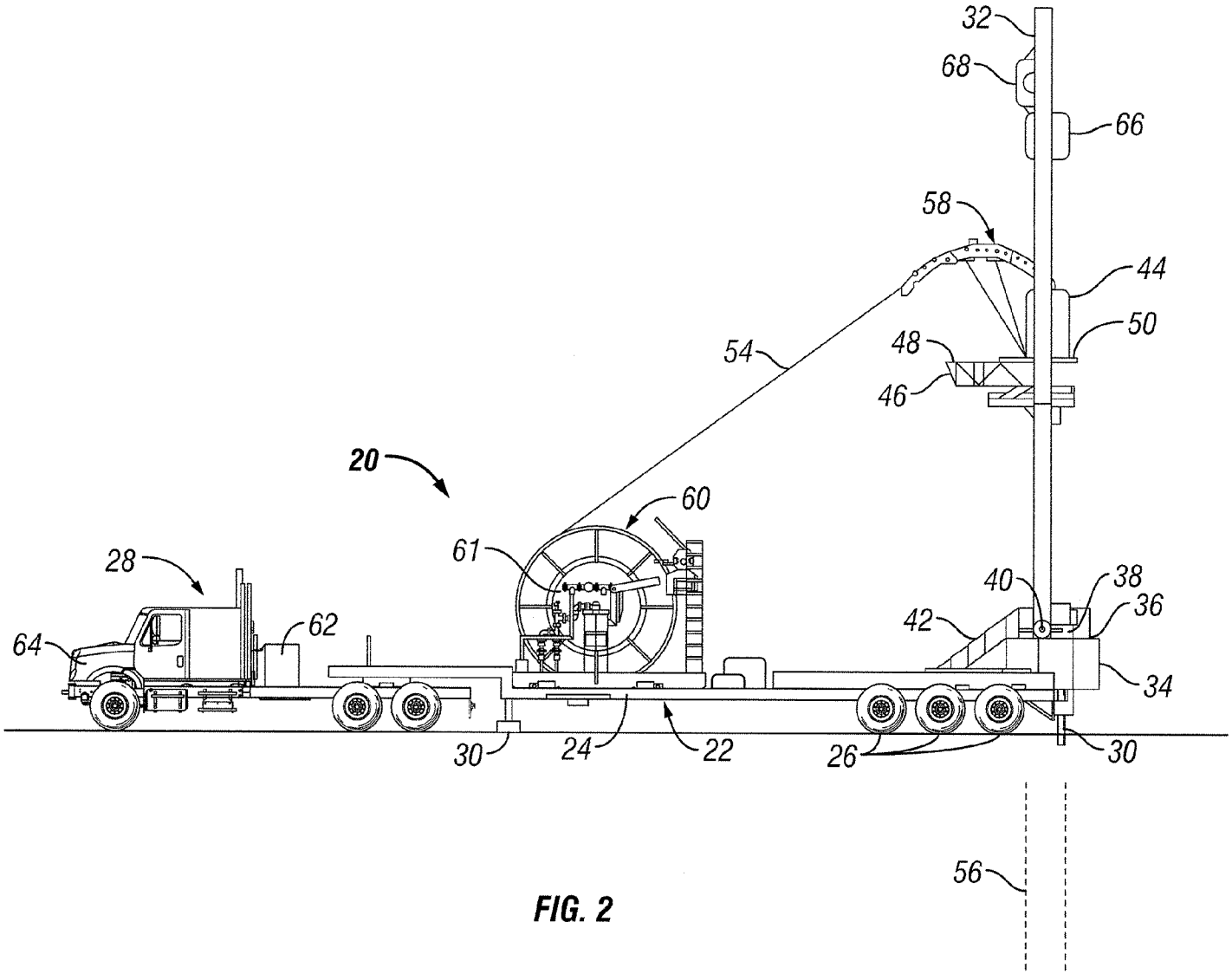
FIG. 2 is a view similar to that of FIG. 1, but showing the drilling and coiled tubing rig in another operational configuration, according to an embodiment of the present invention.

During a coiled tubing operation, such as lowering a bottom hole assembly into wellbore 56, coiled tubing injector 44 is moved into general alignment with mast 32, as illustrated best in FIG. 2. The coiled tubing injector 44 is moved via shuttle mechanism 50 which transfers the injector from an out-of-alignment position, as illustrated in FIG. 1, into general alignment with mast 32 and wellbore 56. In this position, coiled tubing injector 44 can be operated to move coiled tubing 54 into position for engagement with tool string components, e.g. bottom hole assembly components, that are to be moved into the wellbore. In some applications, coiled tubing may be used in a drilling operation. In these applications, the coiled tubing injector is moved into alignment with the area in which the wellbore is to be formed. When switching from a coiled tubing operation to another operation, such as a jointed-pipe drilling operation, coiled tubing injector 44 can again be moved via shuttle mechanism 52 to an out-of-alignment position. It should be noted that in some applications, mounting structure 46 and coiled tubing injector 44 can be designed for movement along mast 32.

Figure 3:
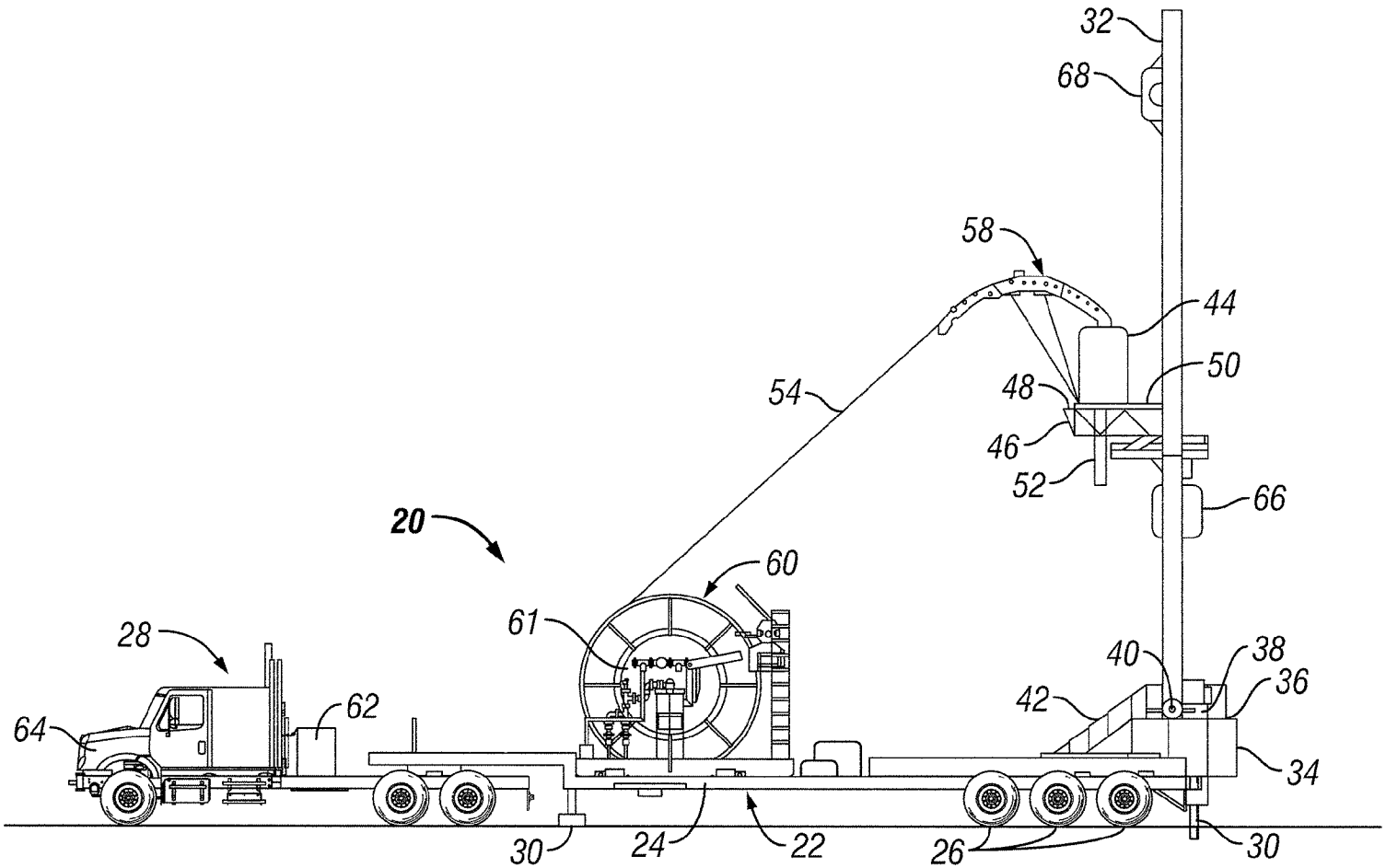
FIG. 3 is a view similar to that of FIG. 1, but showing the drilling and coiled tubing rig in another operational configuration, according to an embodiment of the present invention.

Referring generally to FIG. 3, the starter head 66 is illustrated in a lowered position. The starter head 66 can be moved along mast 32, as necessary, to perform a variety of drilling operations and coiled tubing operations. For example, starter head 66 can be used in the assembly of jointed pipe for a drilling operation. However, starter head 66 also can be used to facilitate a coiled tubing operation. For example, starter head 66 can be used to secure, lift, position, connect and torque connections between bottom hole assembly components that are subsequently coupled to coiled tubing 54 below coiled tubing injector 44.

Figure 4:
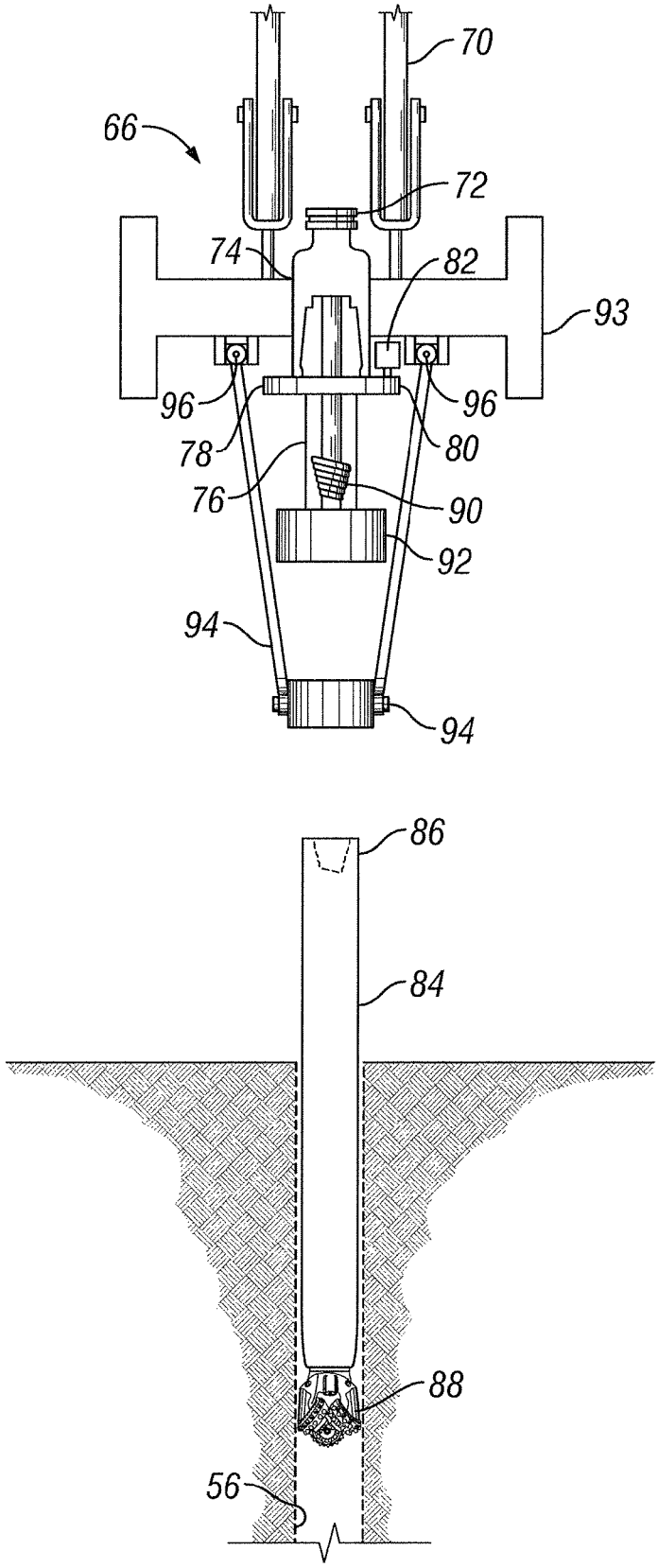
FIG. 4 is an expanded view of an embodiment of a starter head illustrated in FIG. 1, according to an embodiment of the present invention.

An embodiment of starter head 66 is illustrated in FIG. 4. In this embodiment, starter head 66 is coupled to the motion imparting mechanism 68 by an appropriate coupling structure 70. As illustrated, one embodiment of coupling structure 70 comprises a pair of split sheaves. Starter head 66 also may comprise a mud line connection 72 coupled to a rotatable swivel 74 which may be designed to hold pressure while pumping material through mud line connection 72. The rotatable swivel 74 may or may not be rated to hold pressure while rotating, depending on the particular applications in which starter head 66 is utilized. The lower portion of rotatable swivel 74 comprises a quill 76 used for connecting tool string components. For example, quill 76 may be used to connect components of a drilling bottom hole assembly.

A mechanical apparatus 78 is used to rotate quill 76, thereby enabling the formation or "spinning up" of a connection between tool string components. Mechanical apparatus 78 also enables proper application of torque to the connection once formed. By way of example, mechanical apparatus 78 comprises a gear 80 mounted to quill 76 and driven by a motor 82. Motor 82 may be an electric motor or a hydraulic motor that is a relatively simple, low-power, low-cost, standard motor relative to that which would be required for a top drive. The much higher power required for drilling is supplied by a separate drill motor 84 that is moved downhole into wellbore 56 with a drill string 86. Thus, the downhole drill motor 84 provides the power to turn a drill bit 88 completely independently of motor 82 which greatly increases the reliability, simplifies the construction, and lowers the cost of starter head 66.

Starter head 66 may also comprise a stem 90, such as a drill stem, that can be used to engage components being connected or disconnected. Additionally, a hydraulic backup 92 can be used to prevent the tool string components, such as the bottom hole assembly components, from rotating when component connections or disconnections are made. The backup device also can be used to lock quill 76 and prevent rotation of quill 76 during drilling operations with downhole drill motor 84. To further prevent rotation of starter head components during drilling operations, and anti-rotation mechanism 93, such as one or more torque bars, can be positioned between starter head 66 and an adjacent structure, such as mast 32, to prevent unwanted rotation due to torque transferred through drill string 86 during drilling.

The starter head 66 also may comprise elevators 94 that can be used to handle tool string components. For example, elevators 94 can be used to handle bottom hole assembly components during "make-up" or "break-out" operations. Depending on the application, elevators 94 may be formed as powered elevators. Powered elevators have the ability to open and closed remotely. The elevators 94 also can incorporate hydraulic rams 96 constructed to control the position of bails supporting elevators 94. This provides the elevators with greater positioning ability for properly aligning tool string components during installation or removal.

Figure 5:
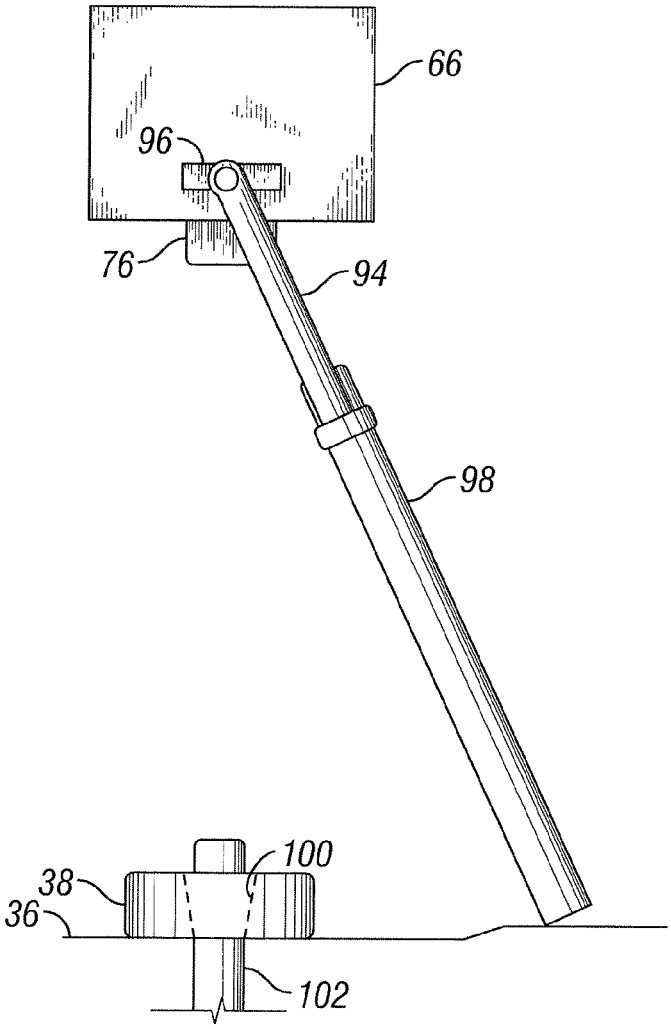
FIG. 5 is a schematic illustration of the starter head being used to lift a tool string component into position for coupling into the tool string, according to an embodiment of the present invention.
Figure 6:
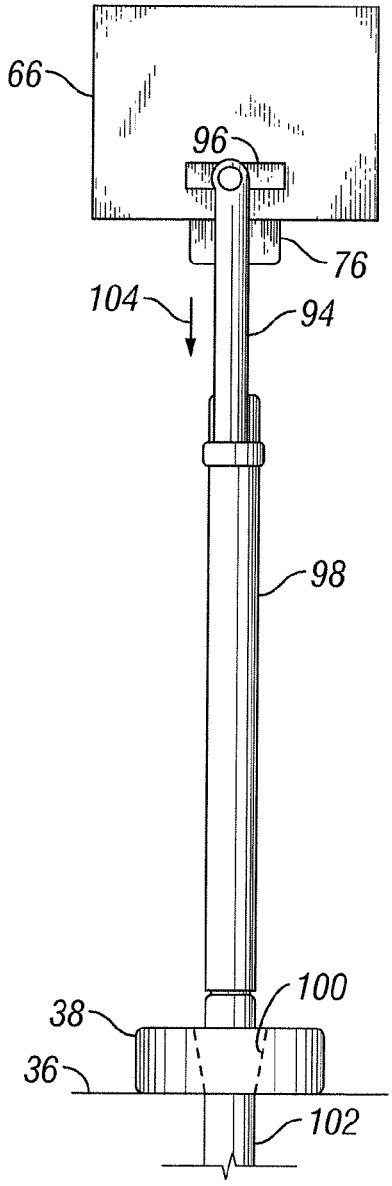
FIG. 6 is a schematic illustration of the starter head being used to rotate and connect the tool string component with the next adjacent tool string component, according to an embodiment of the present invention.

An example of the use of starter head 66 and elevators 94 for coupling components is illustrated in FIGS. 5 and 6. Initially, starter head 66 is moved toward the bottom of mast 32 to enable the securing of a tool string component 98, e.g. a bottom hole assembly component, as illustrated in FIG. 5. Starter head 66 is then raised along mast 32 allowing elevators 94 to pivot as component 98 moves via gravity towards alignment with the component support structure 38, e.g. a rotary table. Once starter head 66 is raised sufficiently such that component 98 is suspended generally vertically above component support structure 38, the component may be lowered into position by lowering starter head 66. For example, component 98 may be lowered into an opening 100 through component support structure 38 for connection to a subsequent component. If a component 102 already has been suspended in component support structure 38, then starter head 66 is used to move component 98 downwardly into engagement with component 102, as illustrated by arrow 104 of FIG. 6. Upon engagement of tool string components 102 and 98, starter head 66 can be lowered to engage quill 76 with component 98. As discussed above, motor 82 is then be used to rotate quill 76 and connect components 98, 102. Motor 82 also can be used to apply proper torque to the connection.

The components and arrangement of components in coiled tubing and drilling rig 20 enable use of the rig in a wide variety of drilling operations and coiled tubing operations, including coiled tubing drilling operations. Additionally, the unique starter head 66 provides great functionality in the handling, connection and disconnection of well related components but with a low risk, highly reliable and relatively inexpensive apparatus. It should be noted, however, that a variety of components can be added to rig 20 or interchanged with illustrated components. Additionally, starter head 66 can be used in a wide variety of applications, including the assembly and disassembly of bottom hole assemblies, the assembly and disassembly of jointed pipe, and in numerous other applications. Also, coiled tubing injector 44 and coiled tubing spool 60 can be used in many types of coiled tubing operations.

Accordingly, although only a few embodiments of the present invention have been described in detail above, those of ordinary skill in the art will readily appreciate that many modifications are possible without materially departing from the teachings of this invention. Such modifications are intended to be included within the scope of this invention as defined in the claims.

What is claimed is:

1. A system for drilling a well, comprising:

a bed;

a mast mounted to the bed;

a coiled tubing injector mounted to the mast, the coiled tubing injector being able to move coiled tubing into the well and out of the well; and a starter head mounted to the mast, the starter head being able to impart rotational motion to make and break connections of tool string components, the starter head being rotationally stationary during drilling operations; and a downhole drill motor coupled to a drill bit to perform drilling operations independent of the starter head, the starter head countering torque generated by the drilling operation.

2. The system as recited in claim 1, wherein the coiled tubing injector is movable between an injection position and a non-injection position.

3. The system as recited in claim 1, further comprising a coiled tubing spool rotatably mounted on the bed.

4. The system as recited in claim 3, further comprising coiled tubing wrapped onto the coiled tubing spool.

5. The system as recited in claim 1, wherein the starter head comprises a mud line connector.

6. The system as recited in claim 1, wherein the starter head comprises a rotatable quill.

7. The system as recited in claim 6, wherein the quill is locked during drilling operations.

8. The system as recited in claim 6, wherein the quill comprises a gear rotated by a motor.

9. The system as recited in claim 1 wherein, the bed is transportable over a public highway system.

10. The system as recited in claim 1, wherein the mast is pivotable between a transport position and an upright position for delivering components downhole.

11. The system as recited in claim 1, wherein the starter head is movable along the mast.

12. The system as recited in claim 1, wherein the coiled tubing injector is movable between at least two positions.

13. A method of performing a drilling operation, comprising:

mounting a mast to a truck bed;

coupling a coiled tubing injector to the mast;

combining a starter head with the mast;

using the starter head to connect and disconnect components of a tool string; and providing power for drilling, independently of the starter head, via a downhole drill motor coupled to a drill string to rotate a drill bit from a downhole location, wherein the starter head the starter head counters torque generated by the drilling.

14. The method as recited in claim 13, further comprising mounting a coiled tubing spool on the truck bed.

15. The method as recited in claim 14, further comprising performing a drilling operation with the downhole drill motor.

16. The method as recited in claim 15, further comprising preventing rotation of the starter head with anti-rotation members during drilling.

17. The method as recited in claim 16, further comprising running coiled tubing downhole via the coiled tubing spool and coiled tubing injector.

18. The method as recited in claim 17, further comprising performing at least one coiled tubing operation with the coiled tubing.

19. The method as recited in claim 16, further comprising pivoting the mast downwardly onto the truck bed for transport.

* * * * *